US008764266B2

(12) United States Patent
Urtiga et al.

(10) Patent No.: US 8,764,266 B2
(45) Date of Patent: Jul. 1, 2014

(54) EDGE-LIT FLAT PANEL REPETITIVE LIGHTING FIXTURE

(75) Inventors: Lucas Urtiga, Laval (CA); Michel Doss, Montréal (CA); Steve Germain, L'Ile-Perrot (CA)

(73) Assignee: GE Lighting Solutions, LLC, East Cleveland, OH (US)

( * ) Notice: Subject to any disclaimer, the term of this patent is extended or adjusted under 35 U.S.C. 154(b) by 77 days.

(21) Appl. No.: 13/436,241

(22) Filed: Mar. 30, 2012

(65) Prior Publication Data

US 2013/0258706 A1 Oct. 3, 2013

(51) Int. Cl.
*F21V 8/00* (2006.01)

(52) U.S. Cl.
USPC ..... 362/616; 362/615; 362/612

(58) Field of Classification Search
USPC ..... 362/600–634
See application file for complete search history.

(56) References Cited

U.S. PATENT DOCUMENTS

| | | | |
|---|---|---|---|
| 5,944,405 | A | 8/1999 | Takeuchi et al. |
| 6,054,932 | A | 4/2000 | Gartner et al. |
| 6,415,531 | B1 | 7/2002 | Ohtsuki et al. |
| 6,745,506 | B2 | 6/2004 | Maas et al. |
| 7,063,449 | B2 | 6/2006 | Ward |
| 7,226,195 | B2 | 6/2007 | Rapeanu |
| 7,357,528 | B2 | 4/2008 | Marsh |
| 2006/0202861 | A1 | 9/2006 | Lo |
| 2009/0219734 | A1 | 9/2009 | Sawada et al. |
| 2010/0321919 | A1 | 12/2010 | Yang |
| 2011/0194167 | A1 | 8/2011 | Jackson et al. |

FOREIGN PATENT DOCUMENTS

| | | | |
|---|---|---|---|
| JP | 2002297070 | A | 10/2002 |
| JP | 2006053449 | A | 2/2006 |

OTHER PUBLICATIONS

Search Report and Written Opinion from corresponding PCT Application No. PCT/US2013/028571 dated Jun. 5, 2013.

*Primary Examiner* — Mariceli Santiago
(74) *Attorney, Agent, or Firm* — Peter T. DiMauro; GE Global Patent Operation

(57) ABSTRACT

A repetitive lighting fixture will alternate between at least two different illuminated images projected in a desired direction. The fixture includes edge-lit flat panels that are configured and/or overlayed to reproduce one or more desired images. Each panel is made of light-transmissive material, which optionally may contain colorant. Each edge-lit flat panel contains optics coupled with a second planar surface of the panel. The optics are arranged to define a desired shape of an image and are configured so as to cause light distributed within the panel to exit a first planar surface of the panel. Each panel has its own light source that projects light into a light transmitting edge of the panel. The panel's light source can include light emitting diodes (LED) that only or selectively illuminate the specific optics of that panel.

5 Claims, 7 Drawing Sheets

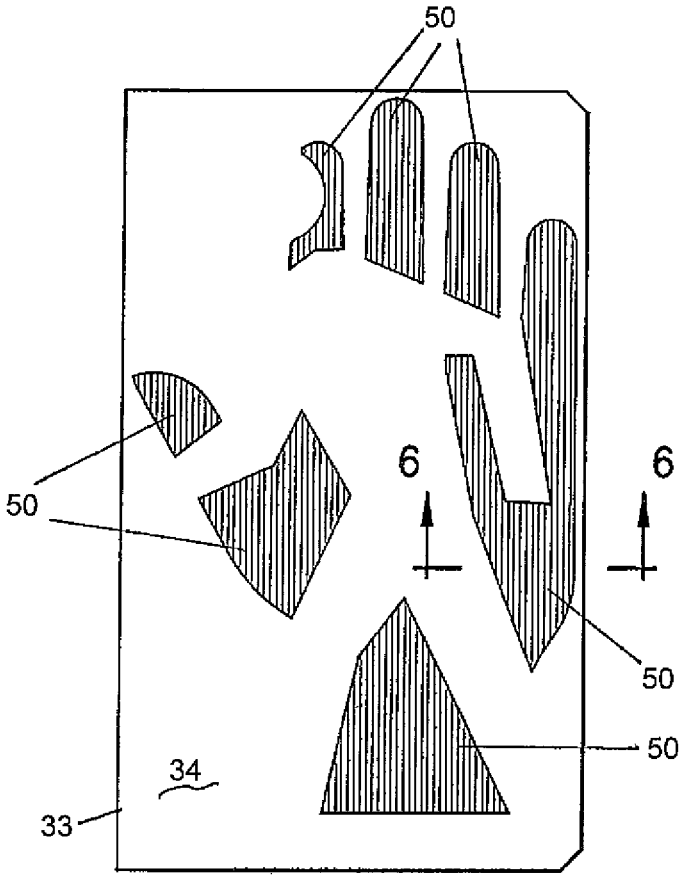
FIG. –5–
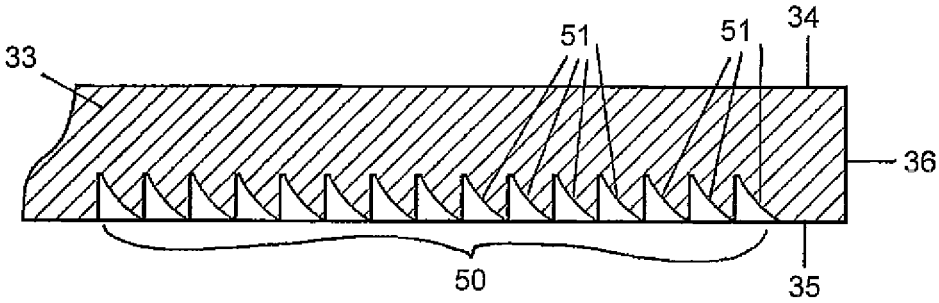
FIG. –6–

EDGE-LIT FLAT PANEL REPETITIVE LIGHTING FIXTURE

BACKGROUND

The field of the present invention relates to repetitive lighting generally, and more particularly, to an edge-lit flat panel repetitive lighting fixture that mixes light from light emitting diodes (LED) in a light waveguide.

Commercial and/or municipal light fixtures operated as traffic, pedestrian and/or other signals cycle on and off continually. Sometimes referred to as repetitive lighting fixtures, such devices tend to be costly to produce and operate. They also tend to occupy significant space on utility poles and other supports.

BRIEF DESCRIPTION

Described and/or shown herein are embodiments of an edge-lit, flat panel for a repetitive lighting fixture. The edge-lit flat panel includes a substrate formed of a light transmissive material. The substrate has a first planar surface, a second planar surface opposite and separated from the first planar surface, and optics coupled with the second planar surface. The optics are arranged to form a desired shape of at least part of an image and configured to reflect light distributed within the edge-lit flat panel through its first planar surface.

Also described and/or shown herein are embodiments of an edge-lit flat panel repetitive lighting fixture is thinner, more energy-efficient, and capable of outputting more lumens than prior systems.

In one embodiment, overlaid edge-lit flat panels are configured to reproduce one or more desired images that are alternately illuminated. Each panel is made of a light-transmitting material (e.g., plastic or glass) and functions as a waveguide. This light-transmitting material may contain a colorant. The panel includes a first planar surface, a second planar surface opposite and separated from the first planar surface, and optics coupled with the second planar surface. The panel's edges connect the first planar surface and the second planar surface, and form a continuous edge about the periphery of each panel. The opposing first and second surfaces may constitute most of the panel's surface area(s).

The second planar surface of each panel includes optics that are arranged to illuminate any desired shape of an image. The image may be formed in whole or in part on one or more second planar surfaces of the panel(s). The image will appear when one or more light sources coupled with the panel(s) are illuminated together, individually and/or in various combinations and/or power settings. The optics reflects light emitted from the light source(s) through the panel(s), and the light exits the first planar surface(s) of the panel(s) to form and project the illuminated image.

A light source may be coupled with one or more edge-lit flat panels. In one embodiment, each panel has its own light source that enters the panel through an edge of the panel. Exemplary light sources may be in the form of a strip of PCB containing light emitting diodes (LED) that only would illuminate the specific optics of that panel. One or more optics coupled with the light sources are configured to cause the light to exit the light output surface of the waveguide in a desired direction that is observable by a viewer.

In another embodiment, at least two panels can be overlaid on top of each other in order to produce different shapes. One or more of these at least two panels may include an intersection optic (or optics) that define a region of both shapes which intersects when the panels are overlaid. A panel coupled with the intersection optics enables simultaneous switching of the shapes and/or colors. Such a panel can include two or more types of light sources, such as light emitting diodes (LEDs) that allow the illuminated image to be changed on demand and/or at predetermined periodic intervals. Changing the illuminated image may involve changing the shape alone, changing the color alone, or changing both shape and color.

BRIEF DESCRIPTION OF THE DRAWINGS

Reference is now made briefly to the accompanying drawings, in which:

FIG. 5 is a plan view of an embodiment of a flat panel waveguide component of a repetitive lighting fixture, wherein the flat panel waveguide component is coupled with one or more optics that are arranged and/or configured to form part of the first image to be projected toward the viewer as in FIGS. 1 and 3;

FIG. 6 is a partial, magnified, cross-sectional view of an embodiment of the flat panel waveguide component of the repetitive lighting fixture of FIG. 5, along the viewing direction of the arrows designated 6-6;

DETAILED DESCRIPTION OF THE INVENTION

As used herein, a coherent image is a visual representation of either a recognizable object or language. The object can be either animate or inanimate and can depict a symbol or graphic. The language can be either alphabetic, numeric or both and can form either a word, numeric, acronym or phrase, which can include either one or more words, one or more acronyms, one or more numerics or some combination of word(s) and/or acronym(s) and/or numeric(s) and/or symbol(s).

As used herein, when a first object is disposed in viewing alignment with a second object, both objects are in the viewer's direct line of sight, even if one object is completely behind the other object so that the object closer to the viewer completely obscures the object that is farther away from the viewer. Either of the two objects can be partially or wholly transparent and/or translucent.

Figure 1:
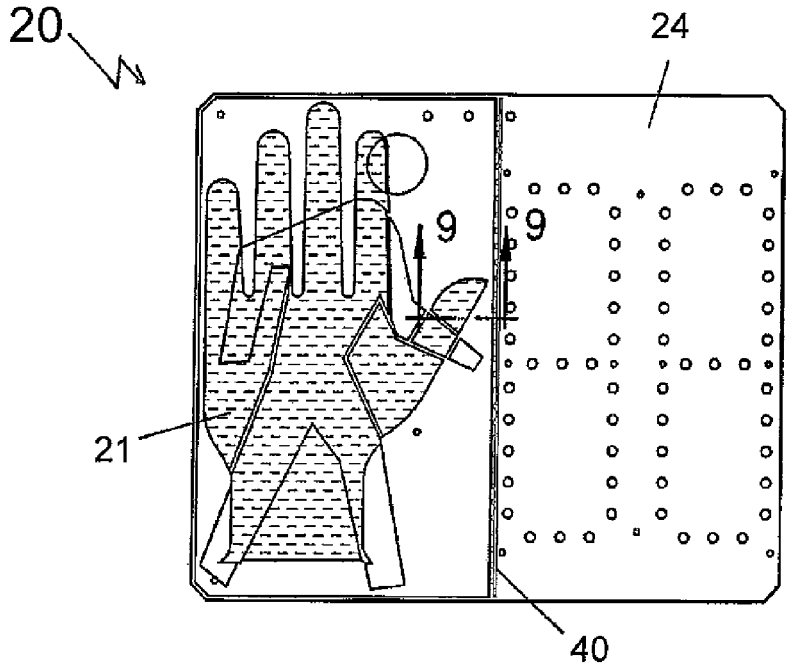
FIG. 1 is a plan view of an embodiment of a repetitive lighting fixture illuminated to project a first image toward the viewer.
Figure 2:
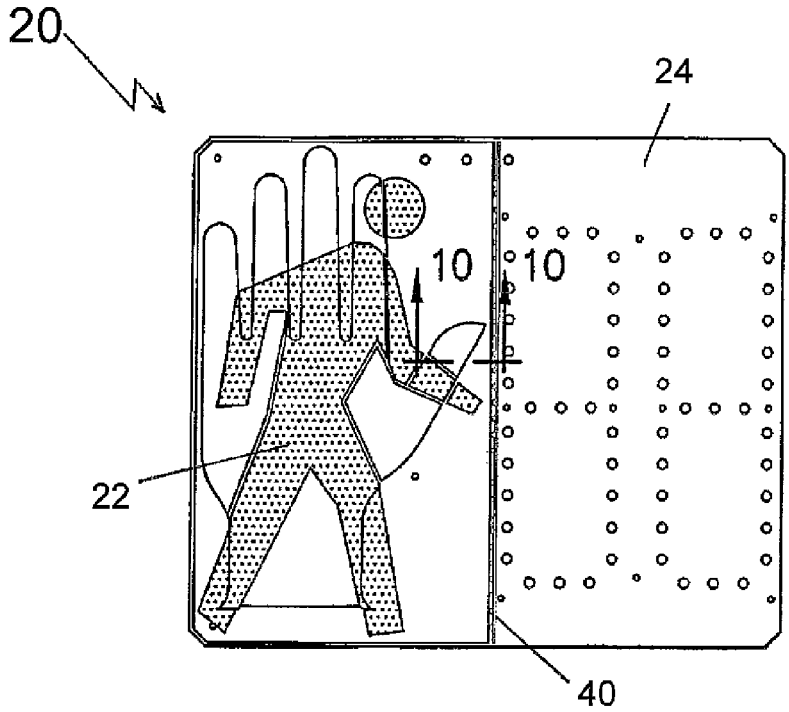
FIG. 2 is the plan view of the embodiment of the repetitive lighting fixture of FIG. 1 illuminated to present a second image toward the viewer.

Broadly speaking, edge-lit flat panel technology is used reproduce a desired image, whether the flat panels are overlaid one on top of another in viewing alignment with each other, or not. In FIGS. 1 and 2, a repetitive light fixture 20 with combination pedestrian (PED) and hand overlay is used herein to illustrate an exemplary embodiment and/or application of the present disclosure. However, the present disclosure is not limited to this exemplary application. Rather, all embodiments and/or applications in which one or more shapes can be displayed and/or overlaid using embodiments of the edge-lit flat panel and/or an edge-lit flat panel light fixture described and/or shown herein are contemplated and intended. Non-limiting examples of types of other applications in which embodiments of the edge-lit flat panel and/or an edge-lit flat panel light fixture include: Walk/Don't Walk signals, arrow signals, x-signals, male/female restroom signals, construction signals, railroad crossing signals, airport signals, runway signals, enter/exit signals, maritime signals, aviation signals, illuminated signs, etc.

Figure 3:
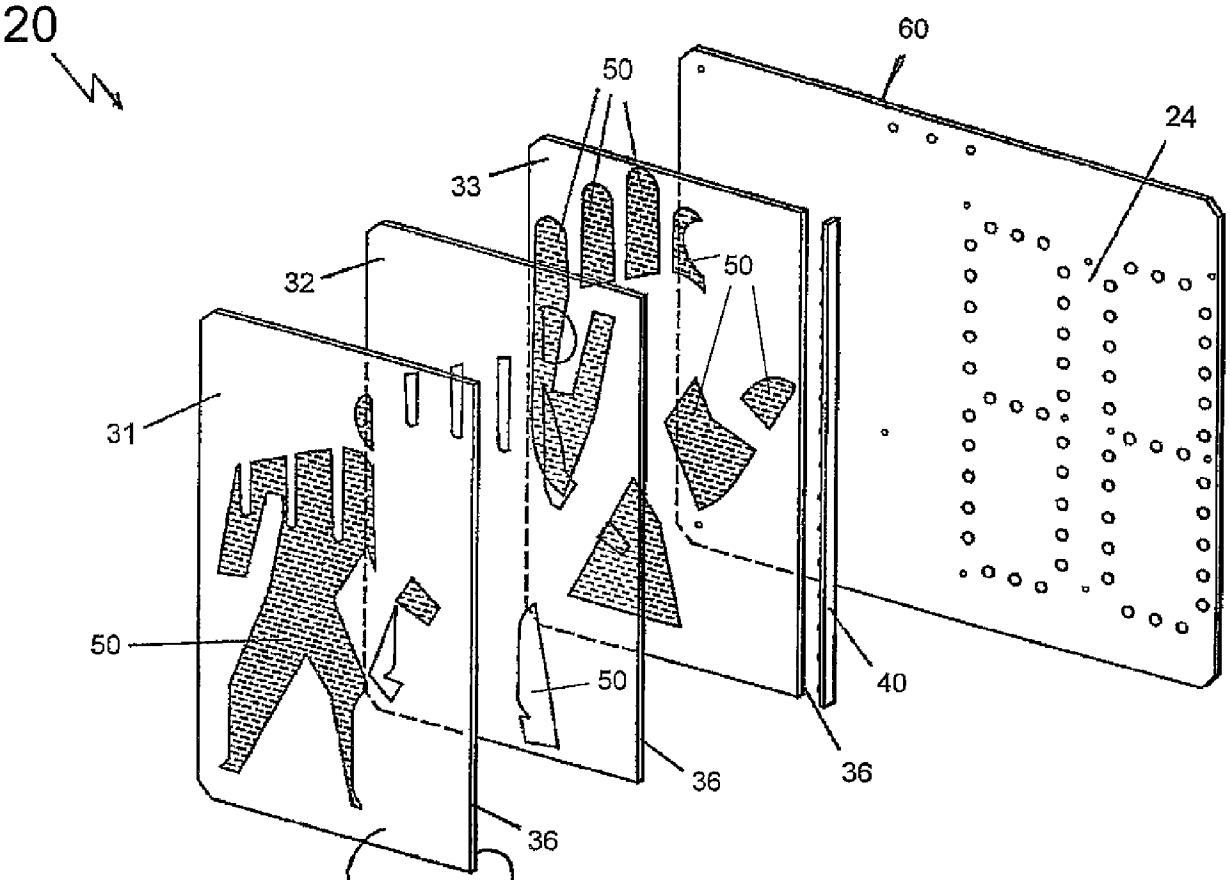
FIG. 3 is an exploded, perspective view of the disassembled components of the embodiment of the repetitive lighting fixture of FIGS. 1 and 2, illuminated to project the first image toward the viewer as in FIG. 1.
Figure 4:
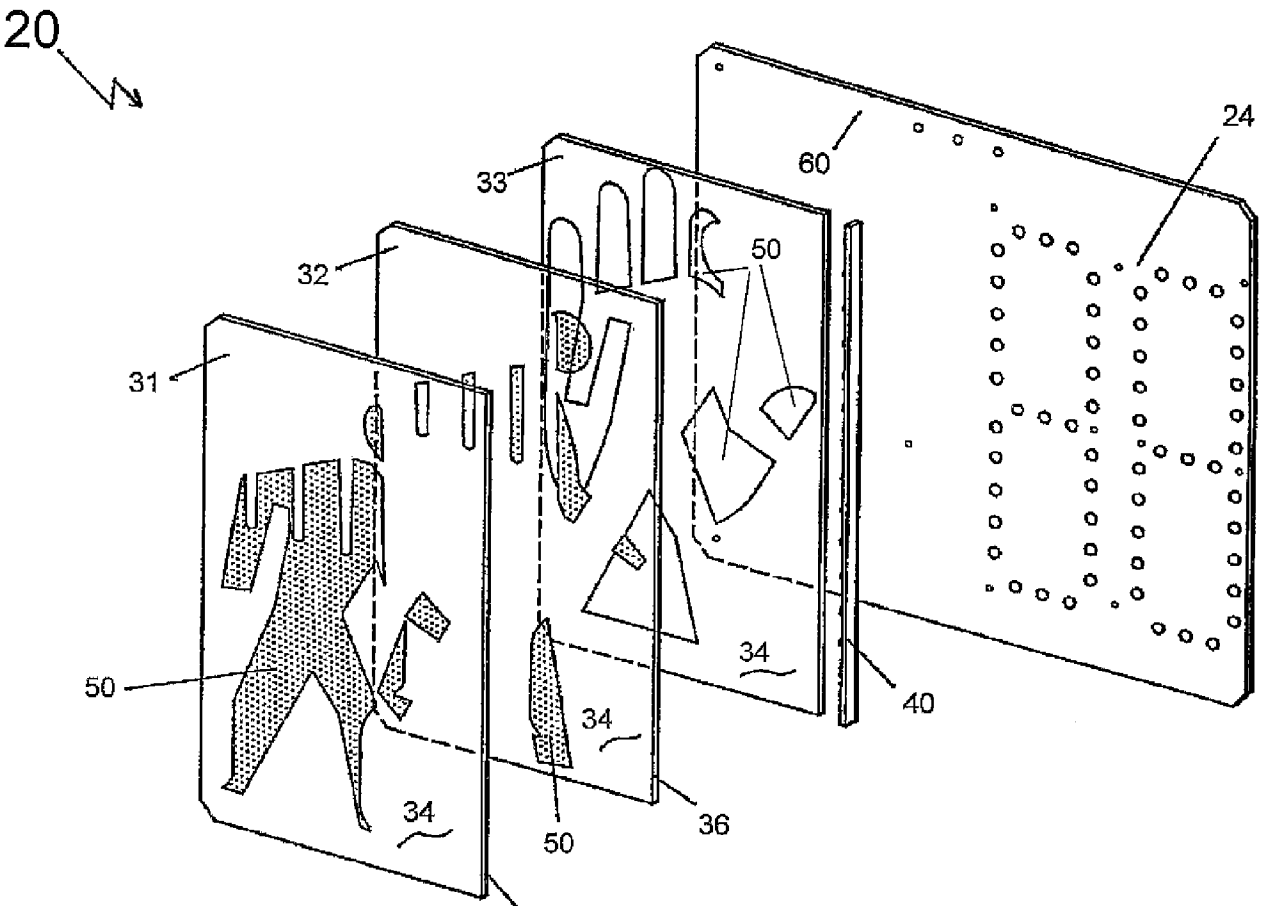
FIG. 4 is an exploded, perspective view of the disassembled components of the embodiment of the repetitive lighting fixture of FIGS. 1 and 2, illuminated with the second image projected toward the viewer as in FIG. 2.

For sake of simplicity and ease of illustration, the same exemplary pedestrian sign 20 is depicted in each of FIGS. 1 and 2 and in a perspective view in FIGS. 3 and 4, respectively. In FIGS. 3 and 4, the pedestrian sign is shown with components disassembled and pulled away from each other to facilitate explanation of the present disclosure. However, in the depictions of FIGS. 1 and 3, a first image 21 of a person's hand is shown in its illuminated state alongside a two digit numerical display 24 that can be illuminated with numbers changing each second to count down the time remaining until the first image projected to the viewer by the sign 20 changes to a second image 22 of a walking person depicted in FIGS. 2 and 4. In other words, the repetitive light source 20 is capable of displaying one or more images. Two in this particular example: a first image and a second image, which is different from and/or overlaid on the first image. The first image may be a first coherent image, as "coherent" is defined above. The second image may be a second coherent image, as "coherent" is defined above.

Similarly, in the depictions of FIGS. 2 and 4, the second image 22 of a walking person is shown in its illuminated state alongside a two digit numerical display that can be illuminated with numbers changing each second to count down the time remaining until the second image projected to the viewer by the repetitive light fixture 20 changes to the first image depicted in FIGS. 1 and 3, e.g., a hand, which tells the viewer to refrain from walking.

An embodiment of a repetitive lighting fixture 20 may be configured so that when it is supplied with power it operates to cycle on and off continually and thereby serially project in a desired direction, at least two different illuminated images. The repetitive lighting fixture may include at least a first edge-lit flat panel and a second edge-lit flat panel. Each edge-lit flat panel defines, and/or is coupled with, a waveguide made of light-transmitting material.

FIGS. 3 and 4 are cross-sectional views of an exemplary embodiment of the repetitive light fixture of FIGS. 1 and 2. Each of FIGS. 3 and 4 shows three superimposed panels 31, 32, and 33. Each panel 31, 32, 33 comprises a flat substrate formed of a light-transmissive material, and is configured to function as an optical waveguide for light emitted into each panel. As schematically shown in FIGS. 3 and 6 for example, each edge-lit flat panel 31, 32, 33 is defined by a pair of opposed planar surfaces 34, 35 that are connected to each other along an edge 36. Hereinafter, planar surface 34 may be referred to as "first planar surface 34" or "first surface 34". Hereinafter, the planar surface 35 may be referred to as "second planar surface 35" or "second surface 35".

The edges 36 form and/or define a continuous periphery of each panel 31, 32, 33. Each panel 31, 32, 33 is desirably manufactured, for example, from a light transmissive material, non-limiting examples of which include: synthetic resin, acryl, polycarbonate, PMMA, or glass. Common or different types of light-transmissive material can be used to form all or some of panels 31, 32 and 33. The planar side surfaces 34, 35 may constitute most of the observable surface area defined a relatively small portion of the surface area defined by each panel 31, 32, 33.

As schematically shown in FIG. 6 for example, a panel 33 has the first planar surface 34 situated opposite the second planar surface 35. When viewed from the side or in cross-section, the edge 36 of the panel 33 connects the first planar surface 34 with the second planar surface 35. In the example shown in FIGS. 1, 2, 3, 4, 5, and 6, the edge 36 is light-transmissive. As explained hereafter, a light source that is associated with the light-transmissive edge 36 will project light through the light-transmissive edge 36 and into the panel 33. Thereafter, internal reflection distributes the light entering the panel 33 through the light-transmitting edge 36 throughout the panel 33, and the distributed light exits the panel 33 through one or more areas of optics 50, which individually or cumulatively form an image.

Figure 8:
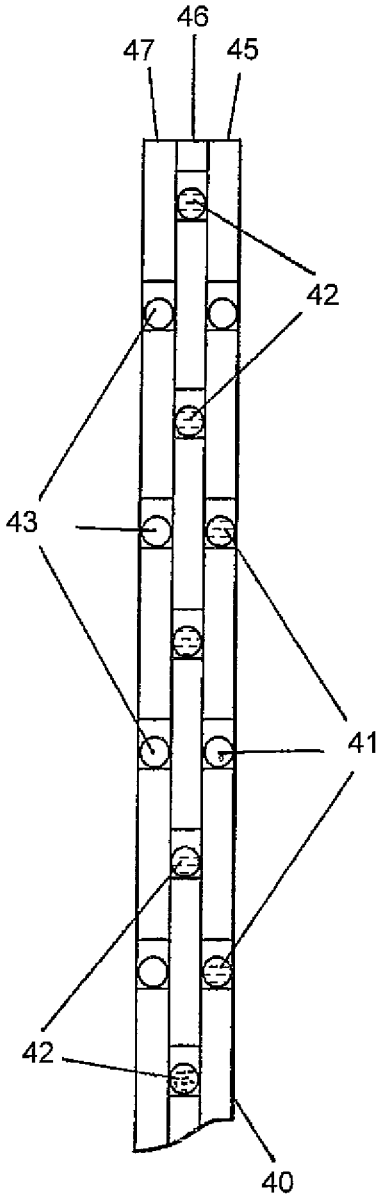
FIG. 8 is a plan view of an embodiment of a light source.

An embodiment of a repetitive lighting fixture 20 desirably includes a light source that is disposed to project light through the light-transmitting edge 36 of at least one of the respective panels 31, 32, 33 when the light source is supplied with power. As schematically shown in FIG. 8 for example, an embodiment of each light source of each edge-lit flat panel desirably comprises a plurality of light-emitting diodes (LEDs) 41, 42, 42. As schematically shown in FIG. 8 for example, the LEDs 41, 42, 42 desirably are mounting on a carrier member 40 that desirably is formed of a thin strip of metal-core printed circuit board (MC-PCB). In the embodiment depicted in FIGS. 8, 9 and 10 for example, each respective panel 31, 32, 33 is provided with its own separate respective row 45, 46, 47 of LEDs 41, 42, 42. Moreover, the row 46 of LEDs 42 can be of a first color, and the row 47 of LEDs 43 can be of a second color. Additionally, the row 45 of LEDs 41 can be composed of some LEDs 41 of the first color and some LEDs 41 of the second color; and the LEDs 41 in the row 45 can alternate between the two colors from one end of the row 45 to the opposite end of the row 45.

However, a different light source, such as a discharge lamp or, in general, a plurality of opto-electronic elements, also referred to as electro-optic elements, such as electroluminescent elements, also can be used. The source brightness of LEDs is many times higher than that of fluorescent tubes. In addition, when use is made of LEDs, the efficiency with which light is coupled into the waveguide panel 31, 32, 33 is higher than in the case of fluorescent tubes. LEDs hardly emit heat, nor do they emit harmful (UV-) radiation. Thus, the use of LEDs as the light source has the advantage that the LEDs 41, 42, 42 may abut against the light-transmitting edges 36 of the panels 31, 32, 33, which can be made of a synthetic resin. The use of LEDs also has the additional advantage that means for coupling light originating from the LEDs 41, 42, 43 into the panels 31, 32, 33, which function as waveguides, are not necessary. Thus, the use of LEDs leads to a more compact repetitive light fixture 20 than was previously available. Moreover, if the LEDs are mounted on a metal-core printed circuit board (MC-PCB), heat generated by the LEDs can be readily dissipated by heat conduction via the PCB.

Various embodiments of the present invention include optics that define a desired shape of at least part of the illuminated coherent image that is desired to be seen by the desired viewer. As schematically shown in FIGS. 5 and 6 for example, optics 50 desirably are arrayed and disposed within the panel 31, 32, 33 along an area of the second planar surface 35 so as to define a desired shape of an image (or a desired shape of a portion of an image). The first planar surface 34 of the panel 31, 32, 33 is configured to allow light reflected from the optics 50 to exit. As schematically shown in the cross-sectional views of FIGS. 6 and 10, the optics 50 of each panel 33 desirably are defined by a pattern of reflective surfaces 51 that extract light entering the waveguide panel 33 and direct the light out of the first planar surface 34 of the panel 33. Accordingly, the optics 50 are defined in the second planar surface 35 of the panel 33 and configured to cause the light entering the light-transmitting edge 36 of the panel 33 to exit the first planar surface 34 of the panel 33 towards a desired direction, namely, in the direction of an intended viewer. Thus, the area defined by the optics 50 becomes illuminated to the eyes of the viewer and defines at least part of a second image 22, which in this example is a walking person.

As schematically shown in FIG. 4 for example, an embodiment of a repetitive lighting fixture 20 desirably can include at least a first edge-lit flat panel 31 and a second edge-lit flat panel 32. At least some portion of the first planar surface 34 of the first edge-lit flat panel 31 overlays at least a portion of the first planar surface 34 of the second edge-lit flat panel 32. As schematically shown in FIG. 10 for example, the optics 50 arrayed and disposed along one or more areas on the second planar surface 35 of the first edge-lit flat panel 31 define one or more desired shapes of the image of the first edge-lit flat panel 31.

Figure 10:
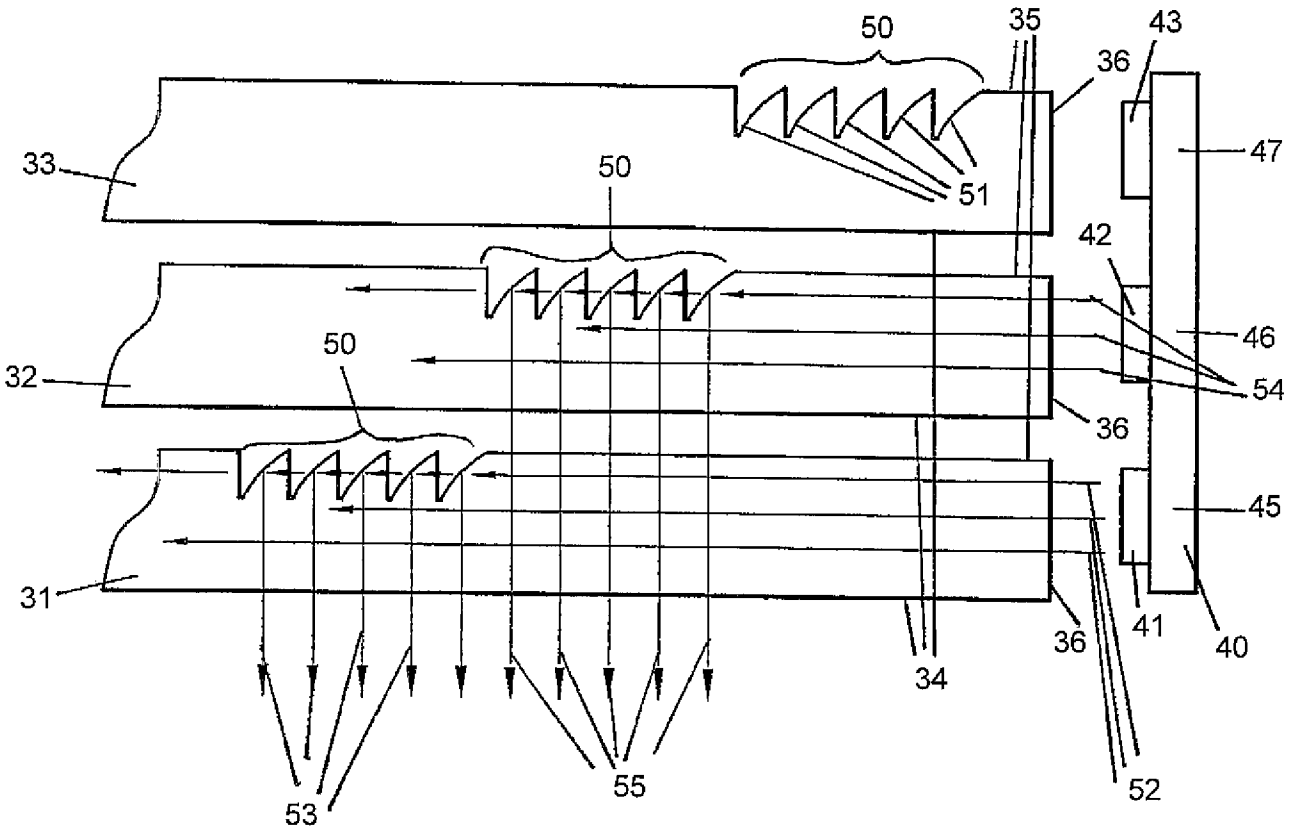
FIG. 10 is a magnified view, partially cut-away and partially in cross-section, of an embodiment of components of the repetitive lighting fixture of FIG. 2, along the viewing direction of the arrows designated 10-10.

As schematically shown in FIG. 10 for example, the optics 50 of the first edge-lit flat panel 31 are configured so as to cause the light (indicated by arrows 52) entering the waveguide 31 of the first edge-lit flat panel to exit (as indicated by arrows 53) the first planar surface 34 of the first edge-lit flat panel 31 towards the desired direction of the intended viewer. Similarly, as schematically shown in FIG. 10 for example, the optics 50 arrayed and disposed along one or more areas on the second planar surface 35 of the second edge-lit flat panel 32 define one or more desired shapes of the illuminated image of the second edge-lit flat panel 32. As schematically shown in FIG. 10 for example, the optics 50 of the second edge-lit flat panel 32 are configured so as to cause the light (indicated by arrows 54) entering the panel 32 to exit (as indicated by arrows 55) the first planar surface 34 of the second edge-lit flat panel 32 towards the desired direction of the intended viewer. Moreover, when the LEDs 41 of the light source for the first edge-lit flat panel 31 and the LEDs 42 of the light source for the second edge-lit flat panel 32 are both illuminated as schematically shown in FIGS. 2 and 10, then a second image 22 of a walking person is directed toward the viewer of the repetitive lighting fixture 20.

As schematically shown in FIGS. 2, 4 and 10, at least some portion of the first planar surface 34 of the second edge-lit flat panel 32 is disposed in viewing alignment with at least a portion of the first planar surface 34 of the first edge-lit flat panel 31. The optics 50 of the first edge-lit flat panel 31 defines less than a complete second image 22 of a walking person, and the optics 50 of the second edge-lit flat panel 32 also define less than a complete second image 22 of a walking person. However, when each of the first and second edge-lit flat panels 31, 32 is illuminated by the respective LEDs of the respectively aligned row 45, 46 of the light source of the repetitive lighting fixture 20, then the two partial images are combined into an illuminated second image 22 of a walking person as shown in FIG. 2. Desirably, the illuminated LEDs 41 of the light source for the first edge-lit flat panel 31 are the same color as the illuminated LEDs 42 of the light source for the second edge-lit flat panel 32 so that the second image 22 appears in the same color to the viewer. However, the coloring of the second image 22 can be made up of more than one color if desired.

As schematically shown in FIG. 3 for example, an embodiment of a repetitive lighting fixture 20 desirably can include at least a third edge-lit flat panel 33 in addition to a first edge-lit flat panel 31 and a second edge-lit flat panel 32. At least some portion of the first planar surface 34 of the first edge-lit flat panel 31 overlays at least some portion of the first planar surface 34 of the third edge-lit flat panel 33.

Figure 9:
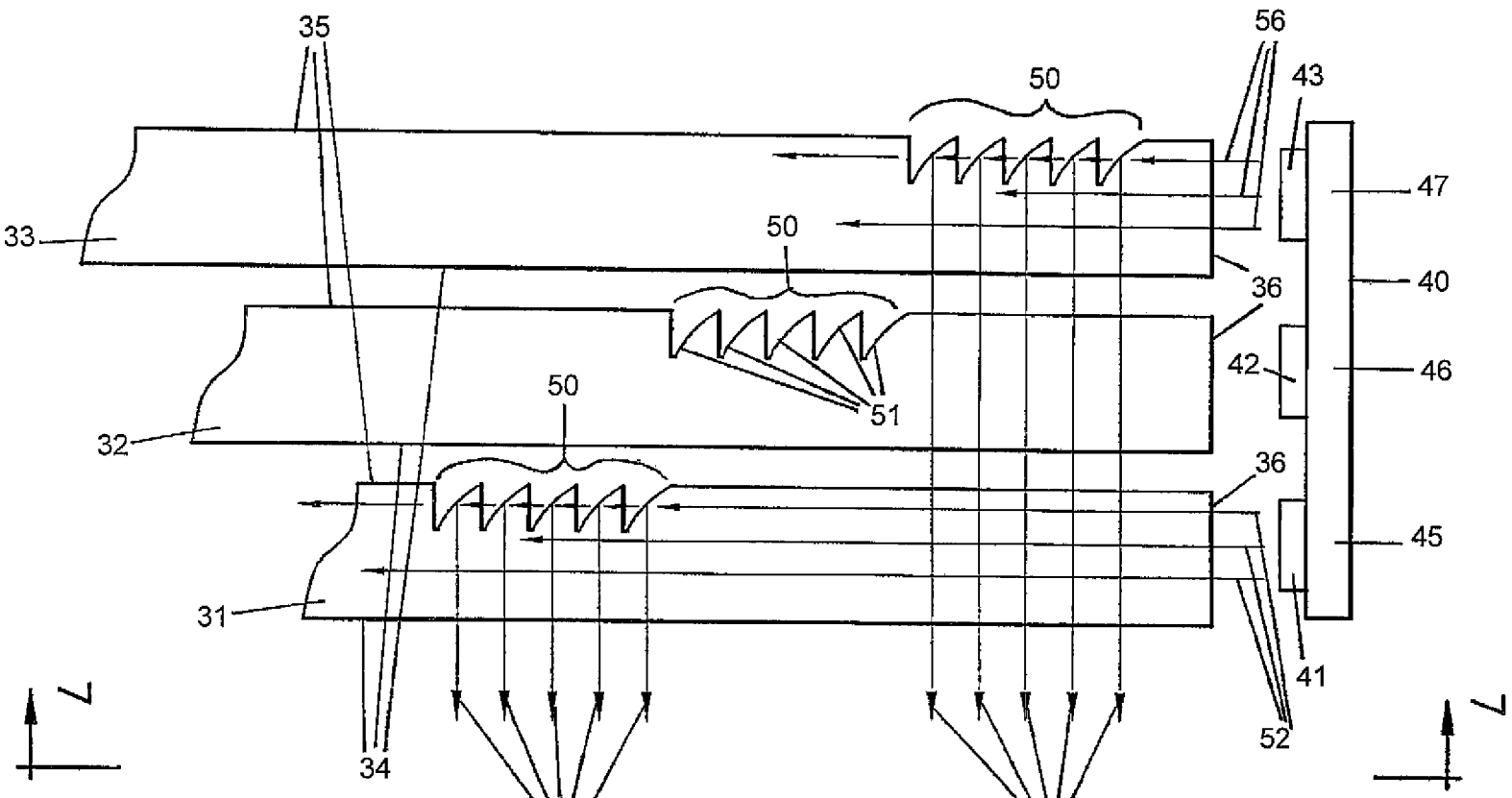
FIG. 9 is a magnified view, partially cut-away and partially in cross-section, of an embodiment of components of the repetitive lighting fixture of FIG. 1, along the viewing direction of the arrows designated 9-9.

As schematically shown in FIG. 9 for example, the optics 50 arrayed and disposed along one or more areas on the second planar surface 35 of the first edge-lit flat panel 31 define one or more desired shapes of an image of the first edge-lit flat panel 31. As schematically shown in FIG. 9 for example, the optics 50 of the first edge-lit flat panel 31 are configured so as to cause the light (indicated by arrows 52) entering the waveguide 31 of the first edge-lit flat panel to exit (as indicated by arrows 53) the first planar surface 34 of the first edge-lit flat panel 31 towards the desired direction of the intended viewer. Similarly, as schematically shown in FIG. 9 for example, the optics 50 arrayed and disposed along one or more areas on the second planar surface 35 of the third edge-lit flat panel 33 define one or more desired shapes of an image of the third edge-lit flat panel 33.

As schematically shown in FIG. 9 for example, the optics 50 of the third edge-lit flat panel 33 are configured so as to cause the light (indicated by arrows 56) entering the waveguide 33 of the third edge-lit flat panel to exit (as indicated by arrows 57) the first planar surface 34 of the third edge-lit flat panel 33 towards the desired direction of the intended viewer. Moreover, when the LEDs 41 of the light source for the first edge-lit flat panel 31 and the LEDs 43 of the light source for the third edge-lit flat panel 33 are both illuminated as schematically shown in FIGS. 1 and 9, then a first image 21 of a person's hand is directed toward the viewer of the repetitive lighting fixture 20.

As schematically shown in FIGS. 1, 3 and 9, at least a portion of the first planar surface 34 of the waveguide of the third edge-lit flat panel 33 is disposed in viewing alignment with at least a portion of the first planar surface 34 of the waveguide of the first edge-lit flat panel 31. The optics 50 of the first edge-lit flat panel 31 defines less than a complete first image 21, and the optics 50 of the third edge-lit flat panel 33 defines less than a complete first image 21. However, when each of the first and third edge-lit flat panels 31, 33 is illuminated by the respective LEDs of the respectively aligned row 45, 47 of the light source of the repetitive lighting fixture 20, then the two partial images are combined into an illuminated first image 21 of a person's hand as shown in FIG. 1. Desirably, the illuminated LEDs 41 of the light source for the first edge-lit flat panel 31 are the same color as the illuminated LEDs 43 of the light source for the third edge-lit flat panel 33 so that the first image 21 appears in the same color to the viewer. However, the coloring of the first image 21 can be made up of more than one color if desired.

In an embodiment of a repetitive lighting fixture 20 as depicted in FIGS. 1, 2, 3 and 4 and FIGS. 7, 8, 9 and 10, each of the panels 31, 32, 33 is in viewing alignment with each of the other panels 31, 32, 33. Moreover, the front panel desirably includes a waveguide 31 that includes intersection optics 50, which enable repetitive switching of the shapes and colors displayed by the fixture 20. The intersection optics 50 of the first panel 31 produce an image that when combined with the image produced by the optics of the second panel 32 yields the second image 22 and when combined with the image produced by the optics of the third panel 33 yields another first image 21, which desirably can differ in shape and/or position from the second image 22.

The panel 31 with intersection optics 50 desirably would be provided with a light source including two or more types of LEDs to be able to vary the color of the illuminated image between two or more colors. However, in an application in which both images are to be the same color, then only one type of LED would be needed. As schematically shown in FIG. 8 for example, the light source of a repetitive lighting fixture 20 has a row 45 of LEDs 41 that includes two colors so that every other LED 41 produces light of a first color and the remaining LEDs 41 produce a second color of light. Accordingly, the repetitive lighting fixture 20 can be configured so that the LEDs producing the first color can be supplied with power while power is denied to the remaining LEDs 41 that produce light of the second color. Similarly, the repetitive lighting fixture 20 can be configured so that the LEDs in the same row 45 producing light of the second color can be supplied with power while power is denied to the remaining LEDs 41 producing light of the first color. By so doing, the first and second images 21, 22 will alternately become illuminated, and the first image 21 will appear to the viewer of the repetitive lighting fixture 20 in a different color than the color of the second image 22.

Figure 7:
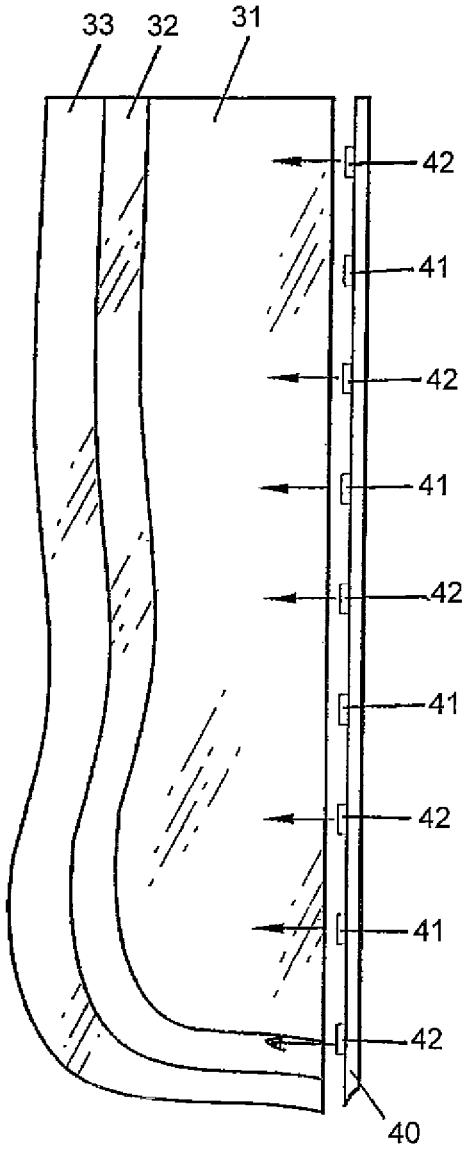
FIG. 7 is a partially cut-away, plan view showing an embodiment of components of a repetitive lighting fixture taken from the viewing direction of the arrows designated 7-7 in FIG. 9.

Moreover, by alternating the supply of power to the light source of the repetitive lighting fixture 20 between two operating modes, the repetitive lighting fixture 20 can be configured to toggle back and forth between the first image 21 and the second image 22. Thus, the light source of a repetitive lighting fixture 20 is configured and disposed to selectively illuminate the first and third edge-lit flat panels 31, 33 or the first and second edge-lit flat panels 31, 32. In a first lighted mode of the operating repetitive lighting fixture 20, the first image 21 is illuminated while the second image 22 is not illuminated for a set time period. In a second lighted mode of the operating repetitive lighting fixture 20, the second image 22 is illuminated while the first image 21 is not illuminated for a set time period. When operating in the first lighted mode to illuminate the first image 21 of FIGS. 1, 3 and 9, power is supplied only to the LEDs 41 of the first row 45 producing the light of the first color and to the LEDs 43 producing light of the same first color in the row 47. When operating in the second lighted mode to illuminate the second image 22 of FIGS. 2, 4 and 10, as schematically depicted in FIGS. 7 and 8 for example, power is supplied only to the LEDs 41 of the first row 45 producing light of the second color and to the LEDs 42 producing light of the same second color light in the row 46.

As schematically shown in FIGS. 3 and 4 for example, a repetitive lighting fixture 20 can include a substrate 60 carrying each of the panels 31, 32, 33 and the light source that includes the LEDs 41, 42, 43 mounted on the carrier member 40. The substrate 60 also desirably can be configured and disposed to carry the time sign 24 alongside the overlying stack of panels 31, 32, 33 and the carrier member 40 for the light source. Moreover, the substrate 60 desirably is formed as a printed circuit board for ease of supplying power to the LEDs 41, 42, 43 and the time sign 24.

The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A lighting fixture, comprising:

a first edge-lit flat panel, a second edge-lit flat panel overlaid the first edge-lit flat panel, and a third edge-lit flat panel disposed in viewing alignment with the first edge-lit flat panel, each edge-lit flat panel formed of a light-transmissive material and including a first planar surface, a second planar surface opposite and separated from the first planar surface, and optics coupled with the second planar surface;

wherein the optics of the first edge-lit flat panel are arranged to form a desired shape of an image of the first edge-lit flat panel and configured to reflect light distributed within the first edge-lit flat panel through its first planar surface, and wherein the optics of the second edge-lit flat panel are arranged to form a desired shape of an image of the second edge-lit flat panel and configured to reflect light distributed within the second edge-lit flat panel through its first planar surface, and wherein the optics of the third edge-lit flat panel are arranged to form a desired shape of an image of the third edge-lit flat panel and configured to reflect light distributed within the third edge-lit flat panel through its first planar surface;

wherein:

the optics of the first edge-lit flat panel defines less than a complete first image;

the optics of the third edge-lit flat panel defines less than a complete first image;

and the image formed by the optics of the first edge-lit flat panel when combined with the image formed by the optics of the third edge-lit flat panel defines a complete first image; and wherein:

the optics of the first edge-lit flat panel define less than a complete second image;

the optics of the second edge-lit flat panel define less than a complete second image;

and the image formed by the optics of the first edge-lit fiat panel when combined with the image formed by the optics of the second edge-lit flat panel defines a complete second image;

the complete first image and the complete second image being different.

2. The lighting fixture of claim 1, wherein when supplied with power said fixture is capable of serially projecting the complete first image and the complete second image.

3. The lighting fixture of claim 1, further comprising a light source coupled with each of the first edge-lit flat panel, the second edge-lit flat panel, and the third edge-lit flat panel.

4. The lighting fixture of claim 3, wherein the light source is configured and disposed to only illuminate or selectively illuminate the first and third edge-lit flat panels or the first and second edge-lit flat panels.

5. The lighting fixture of claim 3, wherein said light source includes a strip of PCB containing light emitting diodes.

* * * * *